US005549493A

United States Patent [19]

Bezzi

[11] Patent Number: 5,549,493

[45] Date of Patent: Aug. 27, 1996

[54] BOAT PROPULSION AND RUDDER DEVICE OF THE TYPE HAVING A SURFACE PROPELLER

[76] Inventor: Paul G. Bezzi, 77 Chemin de l'Avarie, 06810 Auribeau Sur Siagne, France

[21] Appl. No.: 351,593

[22] Filed: Dec. 7, 1994

[51] Int. Cl.[6] ..... B63H 21/26

[52] U.S. Cl. ..... 440/61; 440/57

[58] Field of Search ..... 440/51, 53, 57, 440/58, 59–62, 82, 83, 112

[56] References Cited

U.S. PATENT DOCUMENTS

| | | | |
|---|---|---|---|
| 3,976,027 | 8/1976 | Jones, Sr. | 440/61 |
| 4,544,362 | 10/1985 | Arneson | 440/61 |
| 4,728,308 | 3/1988 | Weismann | 440/57 |
| 4,790,782 | 12/1988 | McCormick | 440/61 |
| 4,846,741 | 7/1989 | Betsinger | 440/61 |
| 5,017,168 | 5/1991 | Ackley | 440/82 |
| 5,290,182 | 3/1994 | Mondelop | 440/57 |

*Primary Examiner*—Jesus D. Sotelo
*Attorney, Agent, or Firm*—Larson and Taylor

[57] ABSTRACT

This device includes: a motor (8) situated inside (14) the boat (2) and comprising an output shaft (7); a propeller (4); a propeller shaft (3) carrying the propeller at one end and being connected (6) by its other end to the output shaft (7) of the motor; a propeller shaft support (1) projecting outward at the stern of the boat (2) and rotationally supporting (1*a*, 1*b*) the propeller shaft (3), this support being mounted on the boat so that it can move horizontally and vertically; a vertical operation ram (13) and a transverse operation ram for moving the propeller shaft support (1) respectively vertically and horizontally. These operating rams (13) are placed inside (14) the boat (2).

14 Claims, 6 Drawing Sheets

BOAT PROPULSION AND RUDDER DEVICE OF THE TYPE HAVING A SURFACE PROPELLER

The present invention relates to boat propulsion devices, of the type having a surface propeller.

The invention relates more particularly to a boat propulsion and rudder device of the type having a surface propeller, including: a motor situated inside the boat and comprising an output shaft; a propeller; a propeller shaft carrying said propeller at one end and being connected by its other end to said output shaft of the motor; a propeller shaft support projecting outward at the stern of the boat and rotationally supporting said propeller shaft, this support being mounted on the boat so chat it can move horizontally and vertically; and operating means connected to said propeller shaft support by a transmission means, these operating means comprising a vertical operation driving member and a transverse operation driving member for moving said propeller shaft support respectively vertically and horizontally.

The conventional propulsion method using a submerged propeller has the drawback, at high speed, of having a lower efficiency due essentially to cavitation phenomena.

Over the past few years, in order to remedy the drawbacks in propulsion using a submerged propeller, a novel method of propulsion has emerged: propulsion using a surface propeller. This propulsion displays its true qualities only when the propeller can be moved horizontally and vertically in order to adapt it under all circumstances to the required conditions of use.

In a known propulsion device of the abovementioned type, actuation of the propeller shaft support in the vertical and transverse directions is obtained by rams sinuated outside the hull of the boat. As a result, these rams are permanently exposed to seawater as well as to all the material and organisms which it contains. The consequence of all this is a decrease in the reliability and longevity of these rams. Furthermore, in the event of breakdown of rams, it is difficult to reach the propeller shaft support manually from inside the boat, in order to sail the boat manually.

The object of the invention is to propose a propulsion device of the abovementioned type which is designed so that it overcomes these drawbacks.

This objective is achieved, in accordance with the invention, owing to the fact that the driving members used to move the propeller shaft support in its two directions of mobility are placed inside the boat and actuate a common transmission means.

By virtue of this feature, the driving members are protected from the attacks of seawater and the bodies which it contains.

In addition, since the driving members are brought back towards the center of the boat, it is possible to avoid shifting the center of gravity of the boat toward the stern, which shift would increase the instability of the boat.

Furthermore, by virtue of the positioning of the driving members inside the boat, maintenance thereof is made easier and, in the event of failure of the sailing-aid systems, such as automatic-control systems, the rudder of the boat remains maneuverable from inside, manually, without any source of energy other than that provided by man.

Advantageously, said vertical operation driving member comprises a ram, preferably a hydraulic ram, hereafter termed vertical operation ram, of which the casing is articulated to the boat, preferably by a ball joint, and the means via which the movements of this ram are transmitted to the propeller shaft support comprise a rod integral with the piston of said ram and coaxial with the latter, which passes through the hull of the boat, projects outward at the stern of the boat, and is articulated via its free end to the propeller shaft support.

Advantageously, the transverse operation driving member comprises a second ram, preferably a hydraulic ram, hereafter termed transverse operation ram, of which a first element, preferably the casing, is articulated to the boat, preferably via a ball joint, and of which the second element: the piston rod, is articulated via its free end to one of the elements, casing or piston rod, of said vertical operation ram.

Advantageously, the vertical operation ram includes a second rod integral with the piston of said ram, coaxial with the latter, and situated in the extension of and opposite the first rod with respect to the piston, and the piston rod of said horizontal operation ram is articulated to said second rod of the vertical operation ram.

According to a preferred embodiment, the propulsion device according to the invention includes, in a way known per se, two juxtaposed propulsion units with parallel axes, each comprising a propeller, a propeller shaft, and a propeller shaft support articulated to the boat, by one of its ends, via a ball joint, the two propeller shaft supports being joined together by a link rod articulated to each of said supports by a joint of axis orthogonal to the corresponding propeller shaft.

According to the preferred embodiment, each propulsion unit is equipped with its own vertical operation ram, and a second link rod parallel to the first link rod joins said vertical operation rams together via one of their elements, casing or piston rod, this connecting rod being articulated to each of these elements.

Thus, the propulsion and rudder device according to the invention makes it possible, by virtue of the movements given to the propeller shaft support by the steering gear comprising the vertical and transverse operation rams and their automatic control system, to vary the position of the propeller in space, in vertical and horizontal planes, in order to obtain, independently or simultaneously, the required propeller positions so that the thrust obtained gives rise, via its effects on the hull, to the gyration and maneuvering movements of the boat without overloading the drive motor or motors.

Furthermore, in this device, it is only mechanical parts which are in contact with the seawater. All the automatic-control hydraulics (that is to say the rams and the associated hydraulic operating members) are accessible from inside the boat, thus facilitating maintenance and monitoring of the system while it is operating.

By acting simultaneously on the vertical and transverse operation rams the propeller is allowed to describe a movement capable of obtaining the steering effects and the motor loads desired by the user.

Other features and advantages of the invention will emerge from reading the description which will follow of one embodiment, the description being given with reference to the appended drawings of which:

Figure 1:
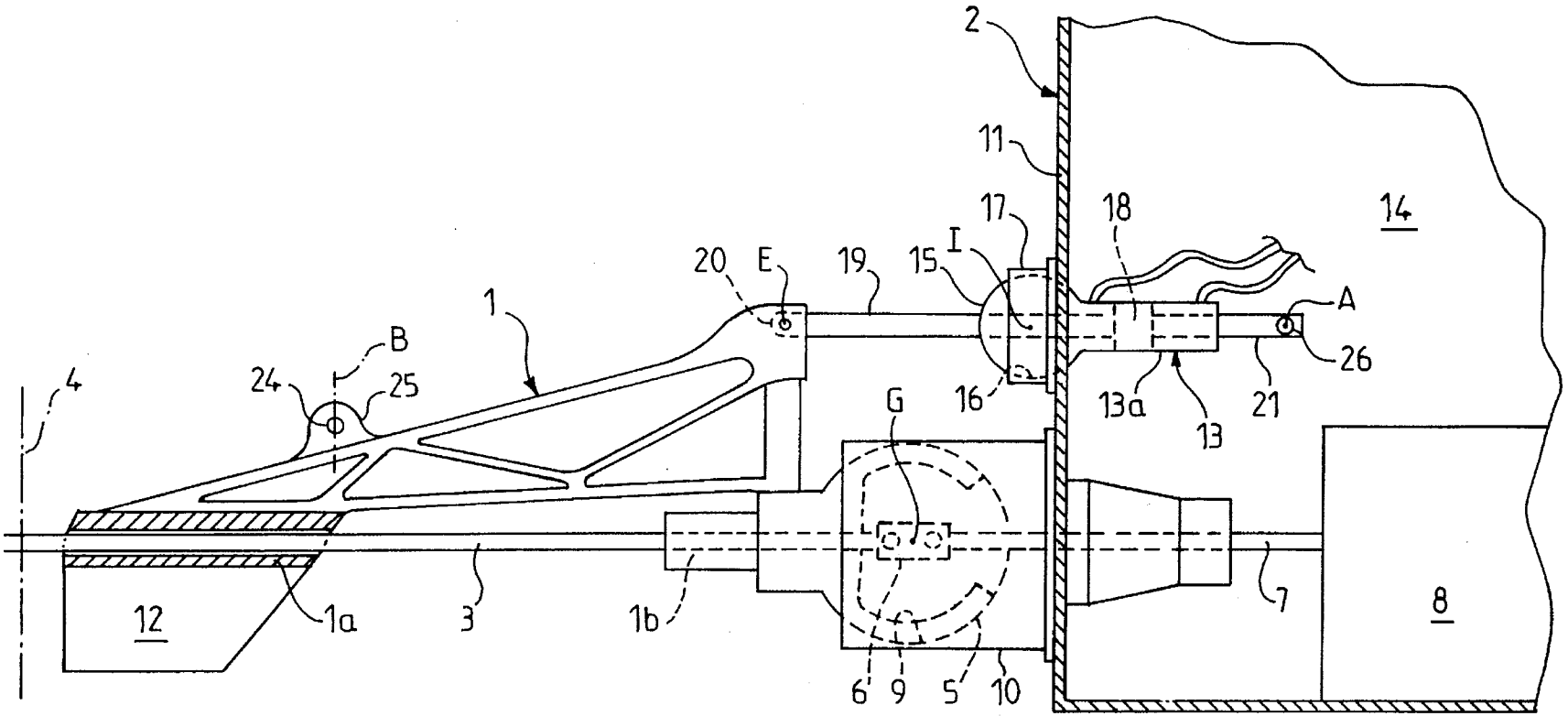
FIG. 1 is a partial diagrammatic view in elevation and in vertical section from the plane I—I of FIG. 2, of a propulsion and rudder device according to one embodiment of the invention.

As can be seen in FIG. 1, the propulsion and rudder device represented comprises a propeller shaft support 1 projecting outward at the stern of a boat 2. The support 1 forms bearings 1*a*, 1*b* in which there rotates a propeller shaft 3 onto which is keyed a propeller 4.

The support 1 includes, at its opposite end from the propeller 4, a hollow sphere 5 housing a cardan joint 6 connecting the propeller shaft 3 to an output shaft 7 of a motor 8 located inside the boat 2.

The hollow sphere 5 is mounted so that it can rotate in a spherical recess 9 of corresponding diameter 9 formed in a component 10 fixed to the stern wall 11 of the boat. The elements 5, 9 and 10 thus form a ball joint via which the support 1 is mounted on the boat 2 so that it can be pivoted in all directions about the center G of said ball joint, which center is also that of the cardan joint 6. An elastomeric gaiter, not represented, connects the component 10 to the support 1 in a leaktight fashion in order to protect the contacting surfaces 5 and 9 of the ball joint from marine elements.

The support 1 carries a rudder 12 at its end adjacent to the propeller 4.

In order to bring about the pivoting of the support 1 in vertical plane, a dual-acting hydraulic ram 13, termed vertical operation ram is provided, located in an inside 14 of the boat 2. The ram comprises a casing 13*a* of which one end 15 of spherical shape passes through the stern wall 11 of the boat and is housed with free pivoting about its center I in a spherical cavity 16 of corresponding diameter formed in a component 17 fixed to the stern wall 11 of the boat on the outer side and above and vertically in line with the component 10. The elements 15 to 17 constitute a ball joint connecting the casing 13*a* to the wall 11 of the boat.

The ram 13 includes a piston 18 to which is fixed a first rod 19 situated on the left-hand side in FIG. 1. The rod 19 is connected by its free end to the support 1 via a joint 20 which, in the example represented, is a joint of horizontal axis E perpendicular to the rod 19 and to the propeller shaft 3. An elastomeric gaiter, not represented, connects the component 17 to the rod 19 in a leaktight fashion in order to protect the contacting surfaces 15, 16 of the ball joint from the marine elements.

The ram 13 includes a second rod 21 which is fixed to the piston 18 on the right-hand side in FIG. 1, and which extends in the extension of the rod 19.

Figure 2:
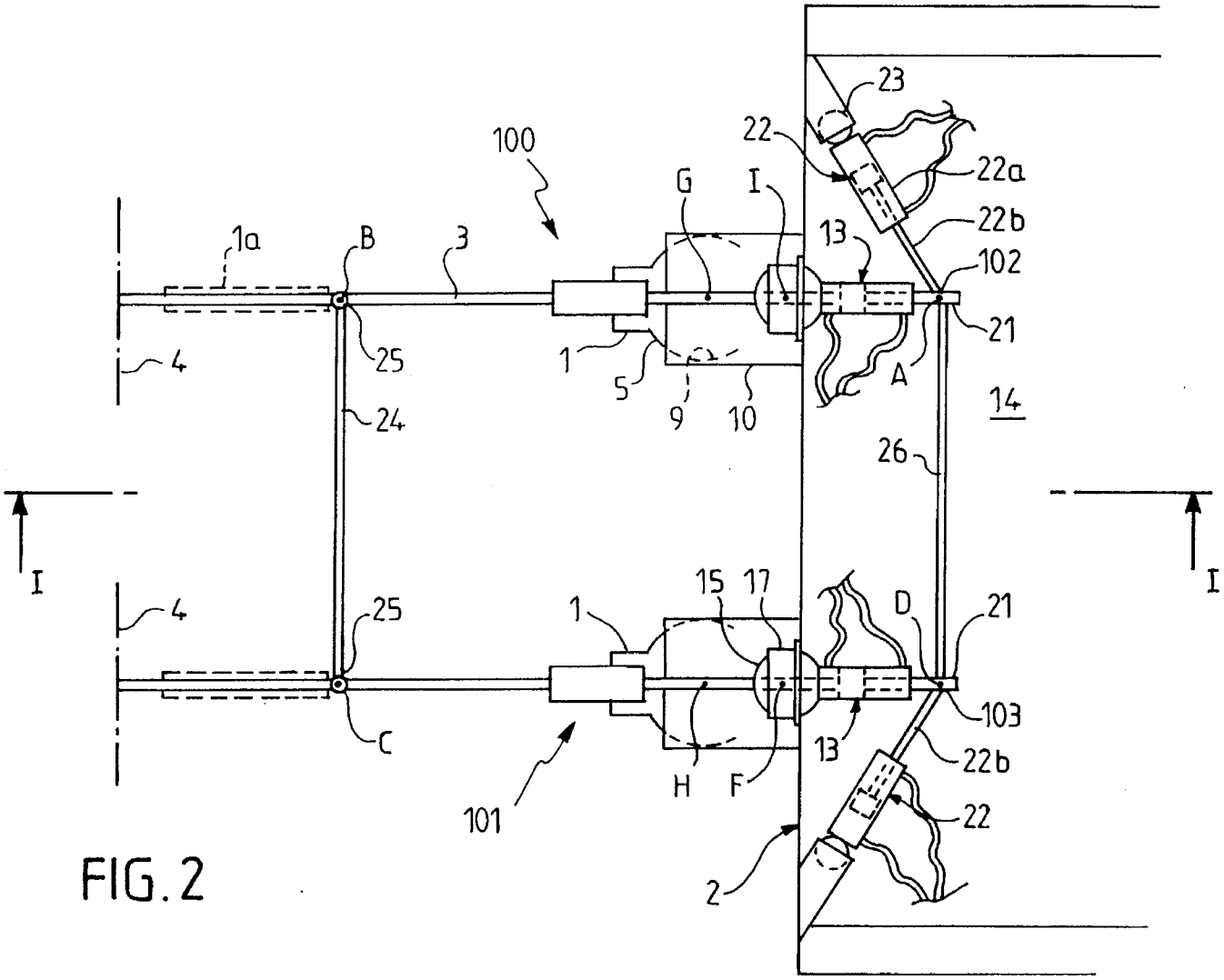
FIG. 2 is a partial diagrammatic plan view of the device of FIG. 1.
Figure 3:
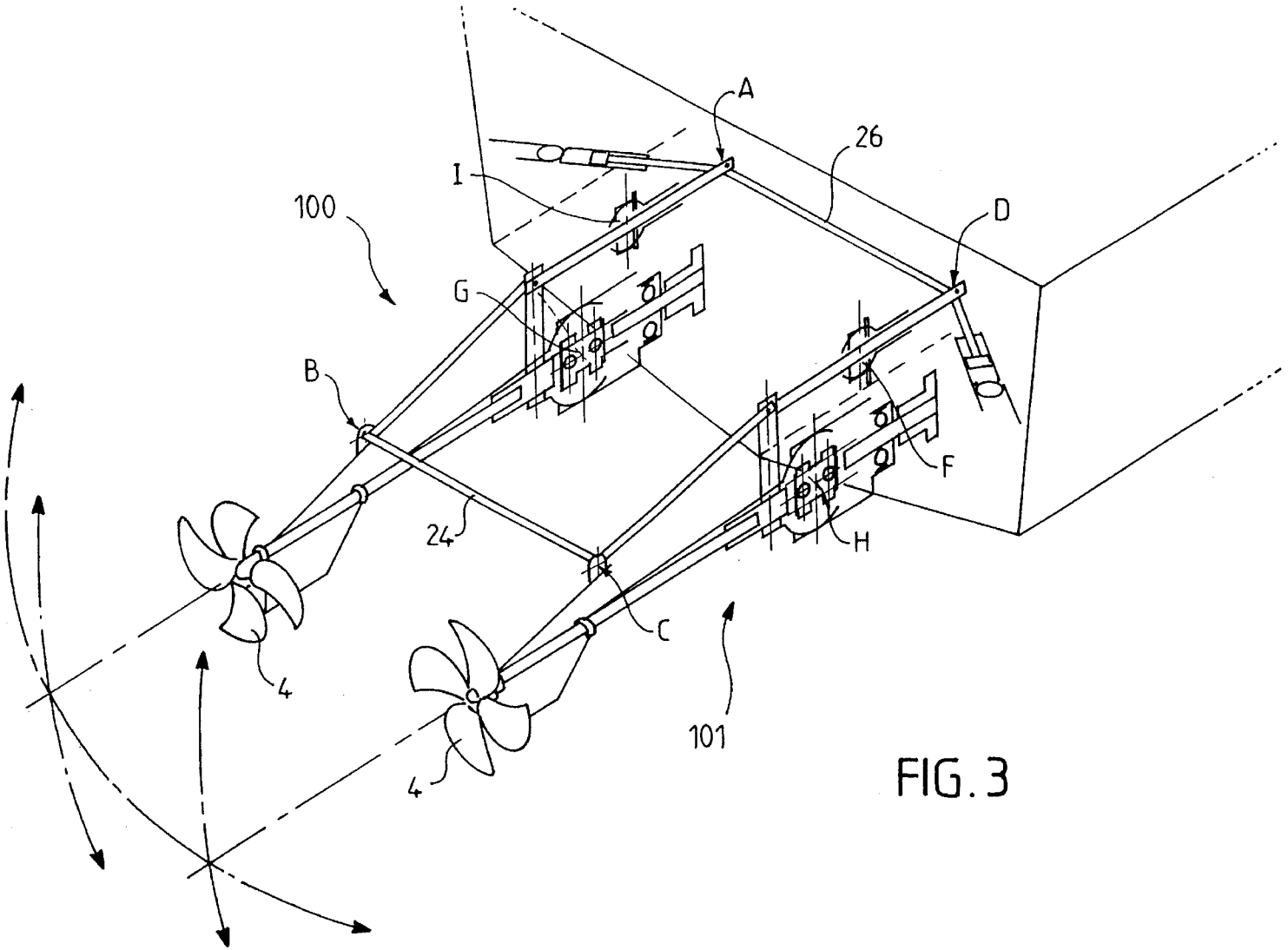
FIG. 3 is a diagrammatic perspective view of the device.
Figure 4:
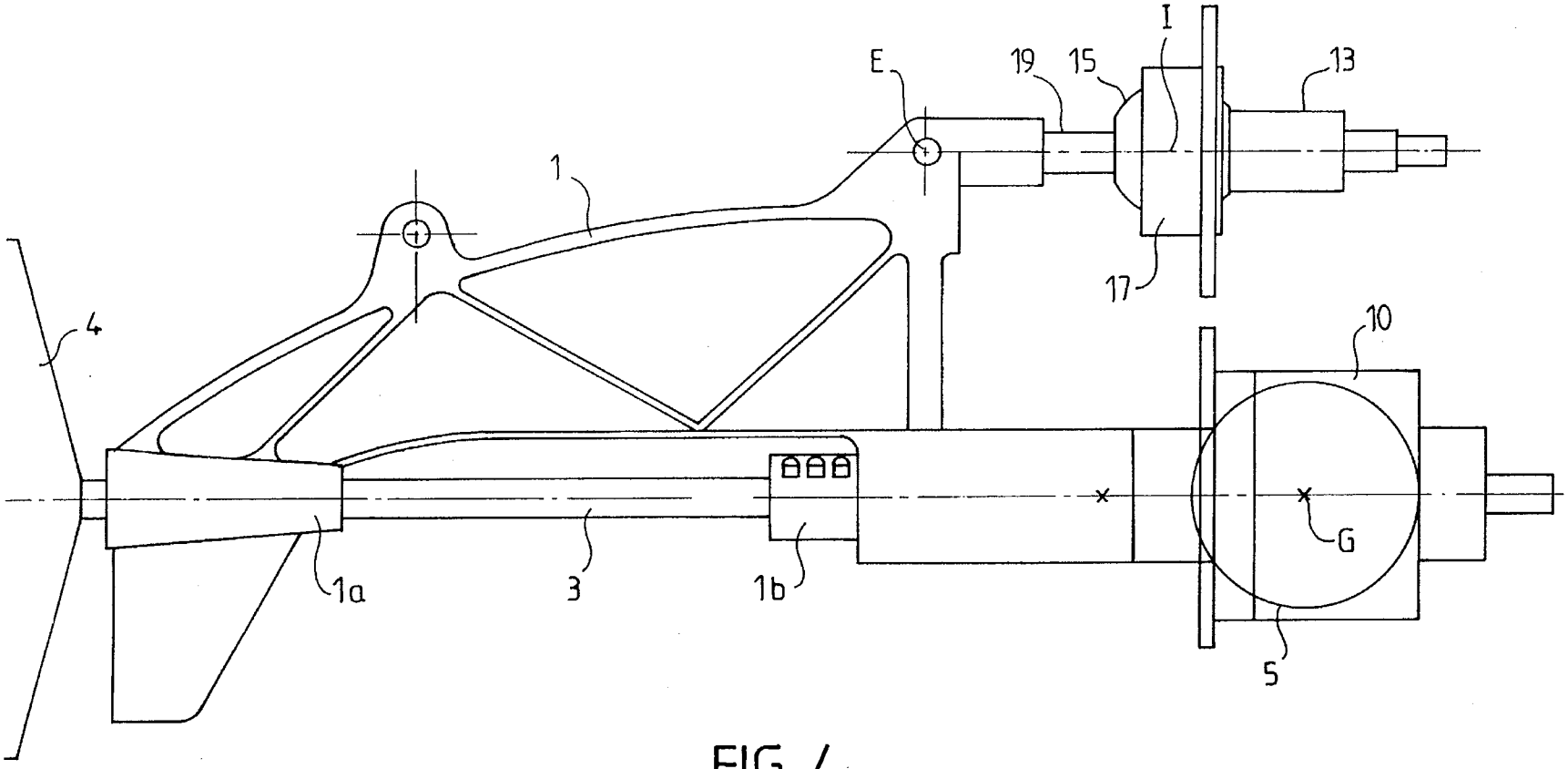
FIG. 4 is a diagrammatic view in elevation of a device according to another embodiment of the invention.

As FIG. 2 shows, the propulsion and rudder device represented includes two juxtaposed propulsion units 100 and 101 parallel to each other, each including a propeller 4, a propeller shaft 3 and a propeller shaft support 1, which is represented only partially in FIG. 2. Furthermore, each propulsion unit 100, 101 is equipped with its own vertical operation ram 13.

In order to bring about the pivoting of the support 1 of each unit 100, 101 in the direction transverse to the shaft 3, a second dual-acting hydraulic ram 22, termed transverse operation ram is provided, located inside 14 the boat 2.

Each transverse operation ram 22 includes a casing 22*a* articulated at one of its ends to the boat 2 by a ball joint 23. Each ram 22 includes, on the opposite side from the ball joint 23, a piston rod 22*b* which is articulated, via its free end, to the second rod 21 of the corresponding vertical operation ram 33 via a ball joint 102 and 103 respectively.

As represented in FIG. 2, each support 1 is articulated to the boat 2, at its end opposite the propeller 4, by a ball joint 5, 9 and 10 of centers G, H respectively. The two propeller shaft supports 1 are joined together by a link rod 24 articulated to each of the said supports by a joint 25 which, in the example B represented, is a joint of axis, respectively B and C, orthogonal to the link rod 24 and to the corresponding propeller shaft 3.

A second link rod 26, parallel to the link rod 24, joins the vertical operation rams 13 together via their second rod 21. The link rod 26 is articulated to each of these rods 21 by a joint of axis, respectively A and D, perpendicular to the link rod 26 and to the adjacent rod 21.

Thus the link rods 24 and 26, together with the supports 1 and the vertical operation rams 13, constitute an articulated parallelogram ABCD (see FIG. 2).

Thus, with the aid of the device which has just been described, the rudder 12 is submerged to a greater or lesser extent by rotating the corresponding support 1 about the point G by causing the angle formed by the "compass" GEA (for the propulsion device 100, FIG. 1) or DFH (for the propulsion device 101, see FIG. 2) to vary. This movement is achieved by means of the ram 13 of which the rods 19 and 21 together form one branch of this compass, which can move both in terms of axial translation and rotate about a point I (or F) the position of which can vary along the length of said branch 19, 21.

Furthermore, if the joints A, B, C, D are produced in the form of ball joints, or some other linkage with three degrees of freedom, it can be seen that it is possible to maneuver just one of the rams 13, so as to deform the parallelogram ABCD. This makes it possible to have different propeller submersions.

In an advantageous embodiment of the invention, the sphere 5 in the component 10 may be located partially or entirely inside the boat, the center G of the ball joint therefore being located inside the boat. This results in even easier possibilities for routine maintenance and repair.

Figure 5:
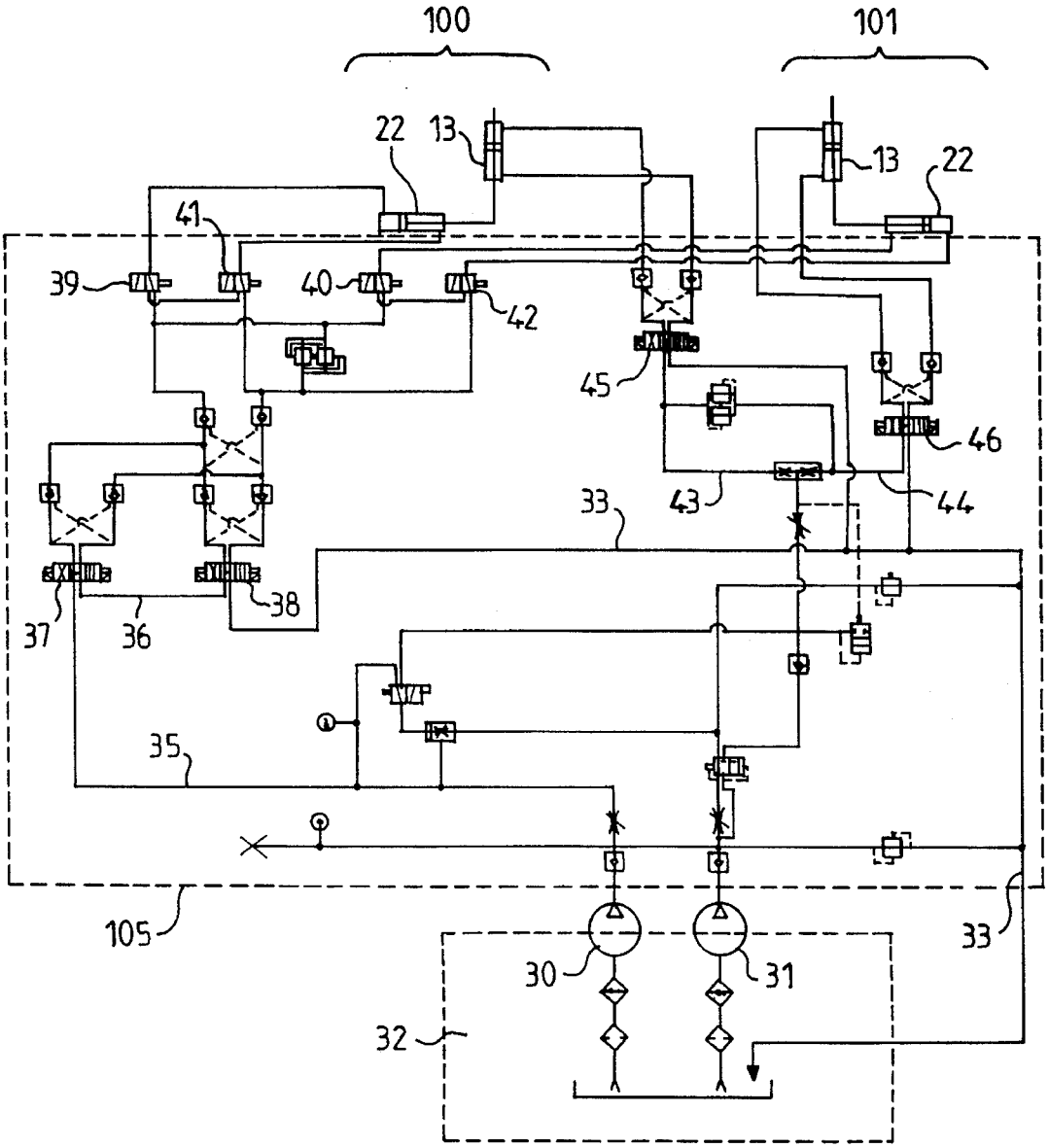
FIG. 5 is a diagrammatic view of the hydraulic operating circuit of the device according to the invention.

Reference is now made to FIG. 5.

A hydraulic operating device which can advantageously be used within the context of the invention is in a modular housing or casing 105 which can be installed in the boat as a single unit. Advantageously this casing may have a control panel equipped with operating buttons, knobs, indicators or other conventional elements which have not been represented. In this casing are provided a set of pipework, solenoid valves, distributor valves and other conventional elements of hydraulic circuits. Advantageously the boat may include two independent hydraulic pumps 30, 31 capable of being started up independently of one another, capable of drawing oil or hydraulic fluid from a reservoir 32 to which the liquid returns via the return-to-tank pipe 33. By means of balancing circuitry also allowing operation even if just one of the pumps 30 and 31 is actuated, the oil delivered by the pumps is sent, by respective pipework 35, 36 to two direction-control solenoid valves 37, 38. These solenoid valves are intended to supply the dual-acting direction control rams 22 either simultaneously for movement to the left, or simultaneously for movement to the right. It can be seen that one of the outlets of each solenoid valve 37, 38 is connected, via bypass distributor valves 39, 40 to the left-hand chamber of the cylinders 22, while the other outlet of the solenoid valves is connected, by similar distributor valves 41, 42 to the right-hand chamber of each of the cylinders 22. Of course the circuit is arranged so that the volume of oil reaching one of the chambers is compensated by the volume of oil leaving the other chamber. The solenoid valve 37 therefore allows steering to the left and of the solenoid valve 38 steering to the right. It is moreover understood that by virtue of the presence of the four valves 39 to 42 it is possible, in the event of one of the rams 22 being defective, to short circuit this ram completely and work only with the second, remaining ram. This therefore gives a great degree of safety to the device.

The pump system 30 and 31 also, via pipework 43, 44, supplies two solenoid valves 45, 46 making it possible to supply the two dual-acting rams 13 separately for moving the units 100, 101 in the vertical plane. The defectiveness of one of the circuits or one of the rams 13 does not prevent one from being able to continue to maneuver the other ram 13 hydraulically.

The device thus produced has several levels of safety. First of all, the operating means are duplicated and each circuit can operate independently of the one which duplicates it. Moreover, as has been explained, one of the rams 22 may be taken out of circuit completely, without hindering the navigation. Moreover, in the event of an electrical breakdown in the assembly 105, it is advantageously possible to envisage mechanical means for operating the solenoid valves 37, 38, 45, 46. Finally, in the event of an overall breakdown of the hydraulic system the fluid in the rams can flow freely back to tank and it is still possible to steer the craft manually, for example simply by manual movement of the bar 26 both vertically and horizontally.

Figure 6:
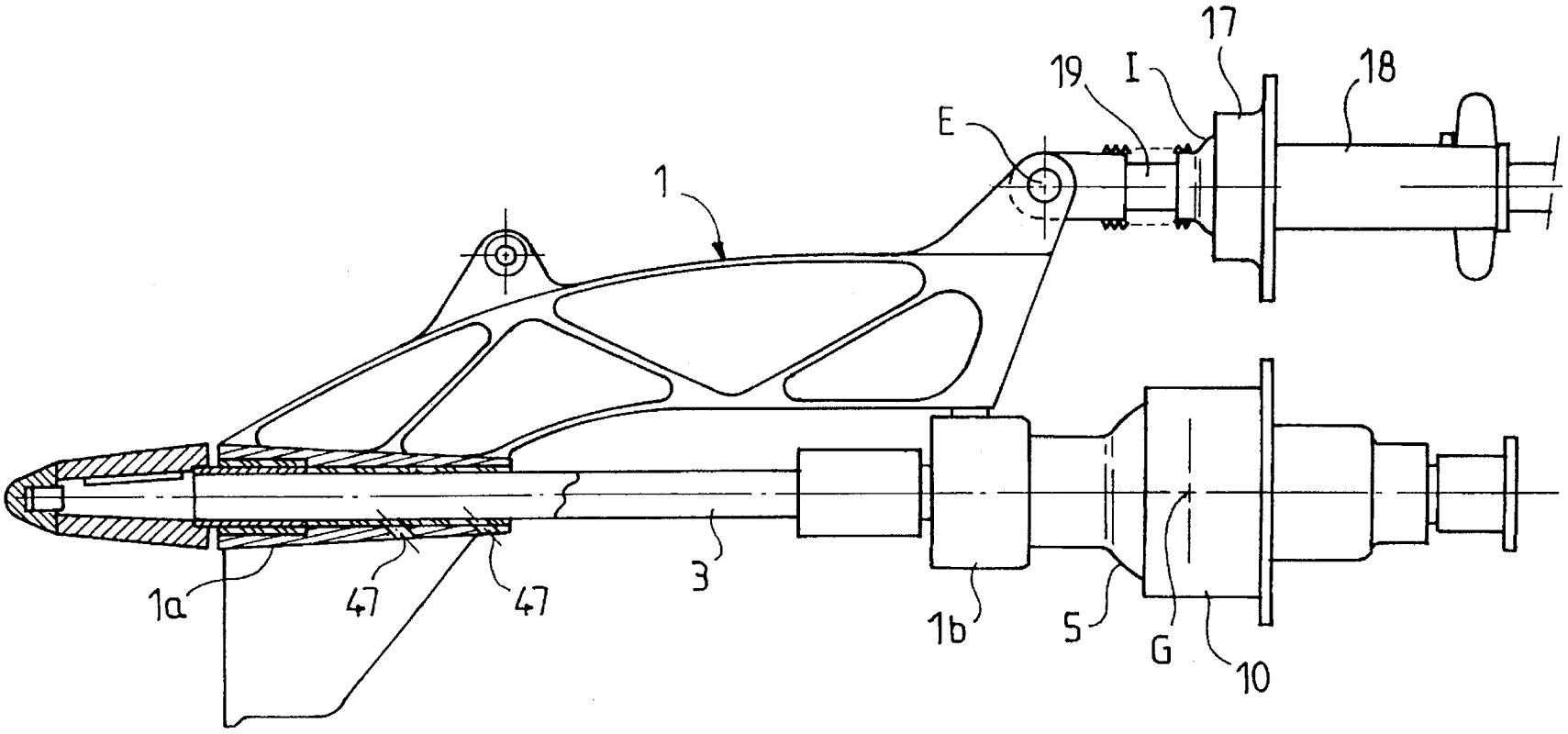
FIG. 6 is a diagrammatic view of a variant of the device.

Referring to FIG. 6, a variant of the invention can be seen in which, for the purpose of shortening the ram rod 19, in order to decrease its overhang, the line joining the point E to the connection of the support 1 to the ball joint 5 has been inclined upward and forward.

What is more, channels 47 inclined forward and downward have been provided, passing through the part 1*a* which forms the sternmost bearing of the propeller shaft 3. These channels scoop up water with an efficiency which increases with the speed of the boat, so that this water penetrates into the bearing and lubricates it with an efficiency which increases with the speed of rotation of the propeller.

The invention is not limited to the embodiment described and represented in the appended drawings, but in contrast extends to all variations which are obvious to those skilled in the art. In particular, the boat propulsion device could include just one propulsion unit such as 100 or 101.

I claim:

1. A boat propulsion and rudder device of the type having a surface propeller, comprising:

a motor situated inside a boat and including an output shaft;

a propeller;

a propeller shaft carrying said propeller at one end and being connected by its other end to said output shaft of the motor;

a propeller shaft support projecting outward at the stern of the boat and rotationally supporting said propeller shaft;

a mounting means, for mounting said shaft support on the boat so that said shaft support can move horizontally and vertically;

an operating means for controlling movements of said propeller shaft support, said operating means including a vertical operation driving member and a transverse operation driving member for effecting movement of said propeller shaft support respectively vertically and horizontally, wherein said driving members are placed inside of the boat; and a common transmission means for commonly linking said propeller shaft support to both said driving members of said operating means, said transmission means including a first end located outside of the boat connected to said propeller support and a second end responsive to said operating means inside of the boat.

2. The propulsion device as claimed in claim 1, wherein said vertical operation driving member comprises a ram having a casing articulated to the boat and a piston, and wherein said transmission means comprises a rod integral and coaxial with the piston of said ram, this rod projecting outward at the stern of the boat and being articulated at a free end thereof to the propeller shaft support.

3. The propulsion device as claimed in claim 2, wherein said casing is articulated to the boat via an end thereof adjacent to said transmission rod.

4. The propulsion device as claimed in claim 2, wherein said casing is articulated to the boat by a ball joint.

5. The propulsion device as claimed in claim 2, wherein said transverse operation driving member comprises a ram having a casing and a piston rod, one of said casing and piston rod being articulated to the boat and the other being articulated via a free end thereof to one of the casing or piston of said vertical operation ram.

6. The propulsion device as claimed in claim 5, wherein said vertical operation ram includes a second rod integral and coaxial with the piston thereof, said second rod being situated in an extension of and opposite to the first-mentioned rod of the transmission means with respect to the piston, and the other of said casing and piston rod of said transverse operation ram being articulated to said second rod of the vertical operation ram.

7. The propulsion device as claimed in claim 5, wherein the one of said casing and piston rod of said transverse operation ram is articulated to the boat by a ball joint.

8. The propulsion device as claimed in claim 5, wherein the one of said casing and piston rod of said transverse operation ram is articulated to the boat by a free end thereof.

9. The propulsion device as claimed in claim 5, wherein the one of said casing and piston rod of said transverse operation ram is the casing of this ram.

10. The propulsion device as claimed in claim 2 and including, two juxtaposed propulsion units with parallel axes, each said propulsion unit comprising a propeller, a propeller shaft, and a propeller shaft support articulated to the boat, by an end thereof via a ball joint, the two propeller shaft supports being joined together by a link rod articulated to each of said supports by a joint with an axis orthogonal to the corresponding propeller shaft, wherein each propulsion unit is equipped with a respective vertical operation ram, and a second link rod parallel to the first link rod joins said vertical operation rams together via ones of their casings or piston rods, said second link rod being articulated to the ones of the casings or piston rods.

11. The propulsion device as claimed in claim 2, wherein said propeller shaft support is mounted so that it can move horizontally and vertically with respect to the boat, by means of a ball joint means situated at least partially inside the boat; and wherein a line joining an end of the rod of said ram to a point of connection between the support and the ball joint means of the shaft is inclined upward and rearward.

12. The propulsion device as claimed in claim 1, wherein said propeller shaft support is mounted so that it can move horizontally and vertically with respect to the boat, by means of a ball joint means situated at least partially inside the boat.

13. The propulsion device as claimed in claim 1, wherein its includes, for actuating said propeller shaft support horizontally and vertically, a hydraulic operating device contained within a housing capable of being connected to two independent hydraulic pumps and including solenoid valve means which are capable of controlling dual-acting rams for controlling steering by means of short-circuit valves making it possible, to short circuit one ram while authorizing operation of another ram and, also for controlling the dual-acting rams for the vertical movement of the support.

14. The propulsion device as claimed in claim 1, wherein the propeller shaft support has an end bearing equipped with channels which are oriented to allow water to be taken in toward the inside of the bearing as a function of the speed of the boat.

* * * * *